US007052335B2

(12) United States Patent
Matsuura et al.

(10) Patent No.: US 7,052,335 B2
(45) Date of Patent: May 30, 2006

(54) ELECTRIC WIRE CONNECTING DEVICE

(75) Inventors: Naoya Matsuura, Yokohama (JP); Kotaro Kobayashi, Atsugi (JP)

(73) Assignee: Molex Incorporated, Lisle, IL (US)

( * ) Notice: Subject to any disclaimer, the term of this patent is extended or adjusted under 35 U.S.C. 154(b) by 42 days.

(21) Appl. No.: 10/508,935

(22) PCT Filed: Mar. 26, 2003

(86) PCT No.: PCT/US03/09008

§ 371 (c)(1),
(2), (4) Date: Sep. 24, 2004

(87) PCT Pub. No.: WO03/083997

PCT Pub. Date: Oct. 9, 2003

(65) Prior Publication Data

US 2005/0159051 A1 Jul. 21, 2005

(30) Foreign Application Priority Data

Mar. 26, 2002 (JP) ..... 2002-085163

(51) Int. Cl.
*H01R 4/48* (2006.01)

(52) U.S. Cl. ..... 439/838; 439/807; 439/783

(58) Field of Classification Search ..... 439/332–348, 439/838, 806, 807, 783

See application file for complete search history.

(56) References Cited

U.S. PATENT DOCUMENTS 3,891,297 A * 6/1975 Poliak et al. ..... 439/807
5,313,033 A * 5/1994 Link et al. ..... 200/401
5,496,186 A * 3/1996 Dobbelaere et al. ..... 439/157

FOREIGN PATENT DOCUMENTS

DE 1063673 8/1959
DE 1104581 4/1961
JP 2000268898 9/2000

OTHER PUBLICATIONS

International Search Report for PCT/US2003/09008, Jul. 3, 2003.

* cited by examiner

*Primary Examiner*—Briggitte R. Hammond
(74) *Attorney, Agent, or Firm*—Thomas D. Paulius

(57) ABSTRACT

An electric wire connecting device 50 has a housing 53 as an outer body; a screw 55 that can rotate freely about a rotation axis 55*a* at a prescribed position in the housing 53 but is prevented from moving in the axial direction; a slider 57 that is threadedly engaged with the screw 55 and makes a go-movement or a return-movement in accordance with the rotation direction of the screw 55; a guide hole 61 through which to introduce an electric wire 59 into the housing 53; and a cam 63 that is in contact with a go-side surface 91 or a return-side surface 93 of the slider 57 and rotates clockwise or counterclockwise in accordance with the movement direction of the slider 57, and presses, at a prescribed rotation position, a portion of the electric wire 59 that is located in the guide hole 61.

13 Claims, 5 Drawing Sheets

ELECTRIC WIRE CONNECTING DEVICE

BACKGROUND OF THE INVENTION

The present invention relates generally to an electric wire connecting device and, more specifically, to a wire connecting device used for connecting electric wires to a printed circuit board that is provided in an electronic apparatus such as a sequencer.

A technique of connecting an electric wire to a printed circuit board is known in which the wire is wound on the shank of a screw and, the screw is then screwed into a hole in a circuit board such that the wire is held between the bearing surface of the head of the screw and the surface of the circuit board. In this cases there may occur a phenomenon that during screwing, the wire is dragged as the screw is rotated. There is the possibility that if part of the wire being dragged is sticking out of the screw and some conductor exists in the vicinity of the screw, the wire may contact the conductor to cause short-circuiting, or the movement of the wire may damage the conductor and its connection to the circuit board.

As a countermeasure against this problem, Japanese Patent Laid-Open No. 268898/2000 discloses a technique of using a cam instead of a screw. A screw is used in this technique to advance the cam close to the wire and this advancement causes the cam to press against the wire as the screw is rotated further; the screw does not serve to directly connect the wire to the circuit board. This type of cam mechanism is used in a wire connecting device that is incorporated in an electronic apparatus as part of it.

The wire connecting device disclosed in the above publication has a housing as an outer body, a wire insertion hole through which to introduce an electric wire into the housing, a cam for pressing the wire that has been introduced while being guided by the wire insertion hole, a screw for causing the cam to function as means for pressing the wire, a manipulation hole into which a driver for rotating the screw is to be inserted, and a terminal to be joined to a circuit board of an electronic apparatus.

If the screw is rotated by inserting a driver through the manipulation hole after the wire has been inserted into the housing through the wire insertion hole, the screw advances or retreats in accordance with its rotation direction.

If the screw is rotated in the advancing direction, the screw contacts the cam in due course. If the screw is rotated further in the same direction, the wire is pressed by the cam. The wire is pressed by the cam at a portion of the terminal to be connected to the circuit board. As a result, the wire is electrically connected to the circuit board via the terminal.

Incidentally, in the technique described in the above publication, the cam is free to rotate when the screw is loose, that is, in the case that the cam is not pressed by the cam ,taking example, before the wire is connected to the circuit board). If in this state the connecting device is moved, or its orientation is changed or reversed to attach it to the electronic apparatus, the cam may rotate about a cam shaft due to its own weight. As a result, the cam may hit the walls etc. of the connecting device, whereby the cam or housing is damaged or sound is generated.

If the screw becomes loose and the cam rotates due to its own weight, the wire insertion hole may be shut by the cam, in which case the operator may not be able to insert into the connecting device, a necessary and sufficient length of the wire.

However, it is difficult to judged, from the outside, whether the wire insertion hole is shut by the cam. Therefore, if the operator inserts the wire into the insertion hole without knowing that the insertion hole is shut by the cam, the advance of the wire (a stranded wire or thin wires constituting it) is obstructed, making it difficult to insert the wire further or possibly unraveling the strands at the end of the wire.

The present invention provides the following measures to solve the above technical problems.

In the invention, rotation of a cam due to its own weight is prevented. To this end, the rotation of the cam is restricted by combining the cam with a slider that makes a go-movement or a return movement in accordance with the rotation direction of a screw.

More specifically, a wire connecting device according to the invention comprises a housing as an outer body; a screw that can rotate clockwise or counterclockwise about a rotation axis at a prescribed position in the housing while is prevented from moving in an axial direction; a slider that is threadedly engaged with the screw and makes a go-movement or a return-movement in accordance with a rotation direction of the screw; a guide hole through which to introduce an electric wire into the housing; and a cam that is in contact with a go-side surface or a return-side surface of the slider, rotates clockwise or counterclockwise in accordance with a movement direction of the slider, and presses the electric wire at a prescribed rotation position.

In the wire connecting device according to the invention having the above configuration, as the screw is rotated, the slider makes a go-movement or a return-movement in accordance with the rotation direction of the screw while friction occurs between the threadedly engaged portions of the screw and the slider.

The cam is in contact with the slider an rotates clockwise or counterclockwise in accordance with the movement direction of the slider. In other words, the cam does not rotate unless the slider is moved.

However, as described above, frictional drag occurs between the threadedly engaged portions of the screw and the slider. Therefore, to move the slider, external force that is stronger than the frictional drag should be exerted on the slider. The cam that is in contact with the slider does not rotate unless the slider is moved. That is, the cam does not rotate unless external force acting on the slider is stronger than the frictional drag. It can be said that the rotation of the cam is restricted by the slider.

Rotating the screw with a driver is not the only cause of external force that acts on the slider; there may occur a case that the cam exerts external force on the slider. For example, the weight of the cam itself may cause external force. In this case, the slider is moved if the force due to the weight of the cam itself is stronger than the frictional drag between the threadedly engaged portions of the screw and the slider.

There may occur a case that the guide hole through which to introduce the wire into the housing is shut by the cam. If the wire is inserted into the guide hole in this state, the advance of the wire is obstructed as described above.

Therefore, the frictional drag between the threadedly engaged portions of the screw and the slider should be sufficiently strong so as to prevent an event that the weight of the cam itself overcomes the frictional drag between the threadedly engaged portions of the screw and the slider and the cam shuts the guide hole undesirably. That is, it is desirable that the frictional drag that occurs between the threadedly engaged portions be set strong enough to prevent movement of the slider even if force due to the weight of the cam itself acts on the slider.

This measure prevents the cam from moving undesirably, and hence the cam can be prevented from hitting the walls or the constituent parts of the wire connecting device. Further, there does not occur a phenomenon that the cam shuts the wire insertion hole. Therefore, even if the wire is inserted into the wire insertion hole without checking whether it is shut by the cam, the advance of the wire (a stranded wire or thin wires constituting it) is not obstructed. This effectively prevents a phenomenon that it is difficult to insert the wire into the insertion hole or a stranded wire is unraveled.

These and other objects, features and advantages of the present invention will be clearly understood through a consideration of the following detailed description.

BRIEF DESCRIPTION OF THE DRAWINGS

In the course of this detailed description, the reference will be frequently made to the attached drawings in which.

DETAILED DESCRIPTION OF THE PREFERRED EMBODIMENT

An electric wire connecting device according to an embodiment of the present invention will be hereinafter described with reference to the drawings.

Figure 1:
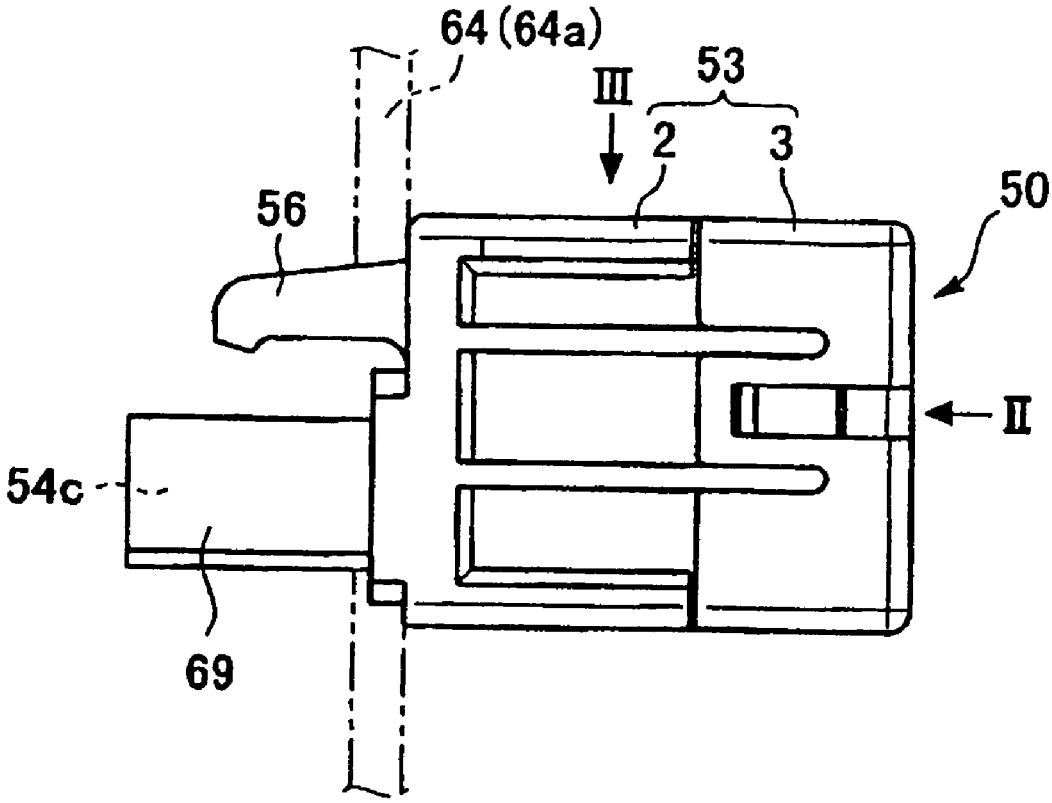
FIG. 1 is a side view of a wire connecting device constructed in accordance with the principles of the present invention.

FIG. 1 is a side view of a wire connecting device 50 that is constructed in accordance with the principles of the present invention and shown attached to a panel 64*a* of an electronic apparatus 64. The connecting device 50 provides a connection between a plurality of electrical wires 59 and circuits on a circuit board 66 that is disposed within the device 64 and behind the panel 64*a* thereof.

Figure 2:
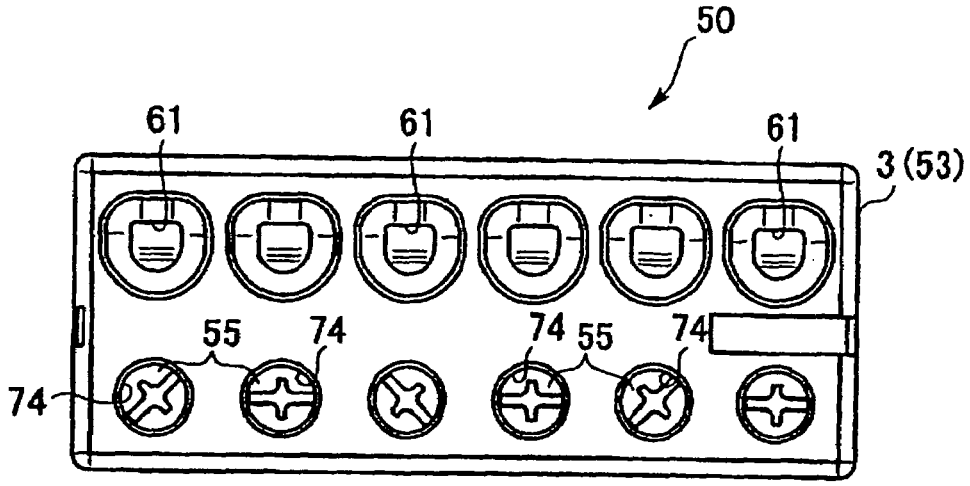
FIG. 2 is an inverted front elevational view of the wire connecting device of FIG. 1, taken from the direction of arrow II thereof.
Figure 3:
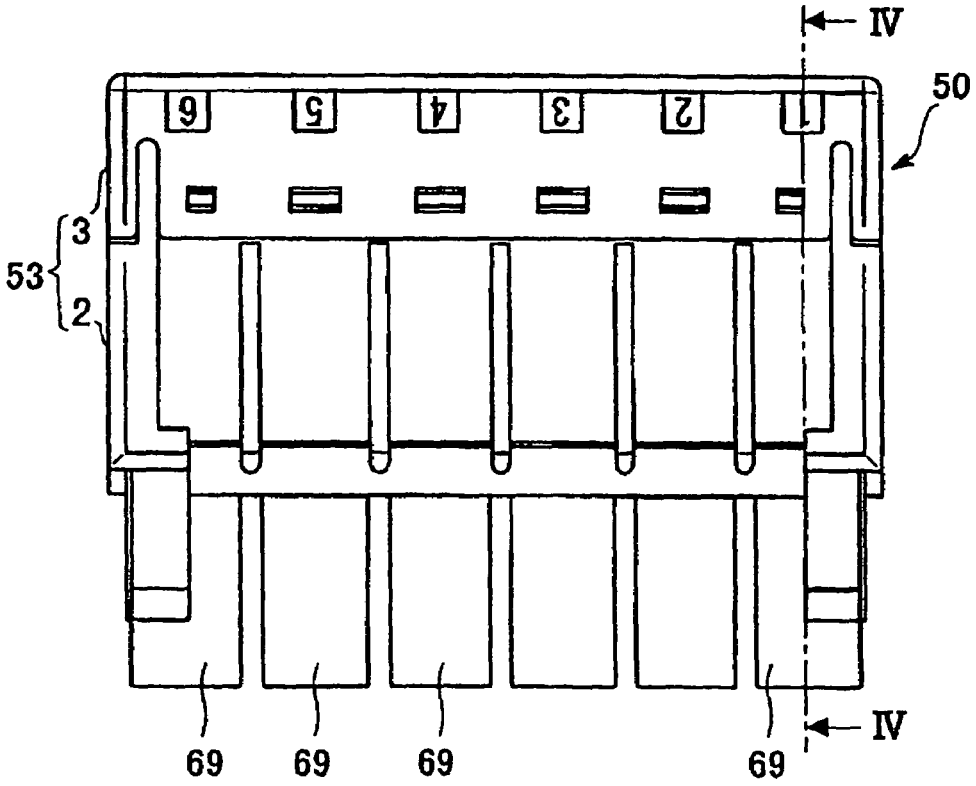
FIG. 3 is a top plan view of the wire connecting device of FIG. 1 taken from the direction of arrow III thereof.
Figure 4:
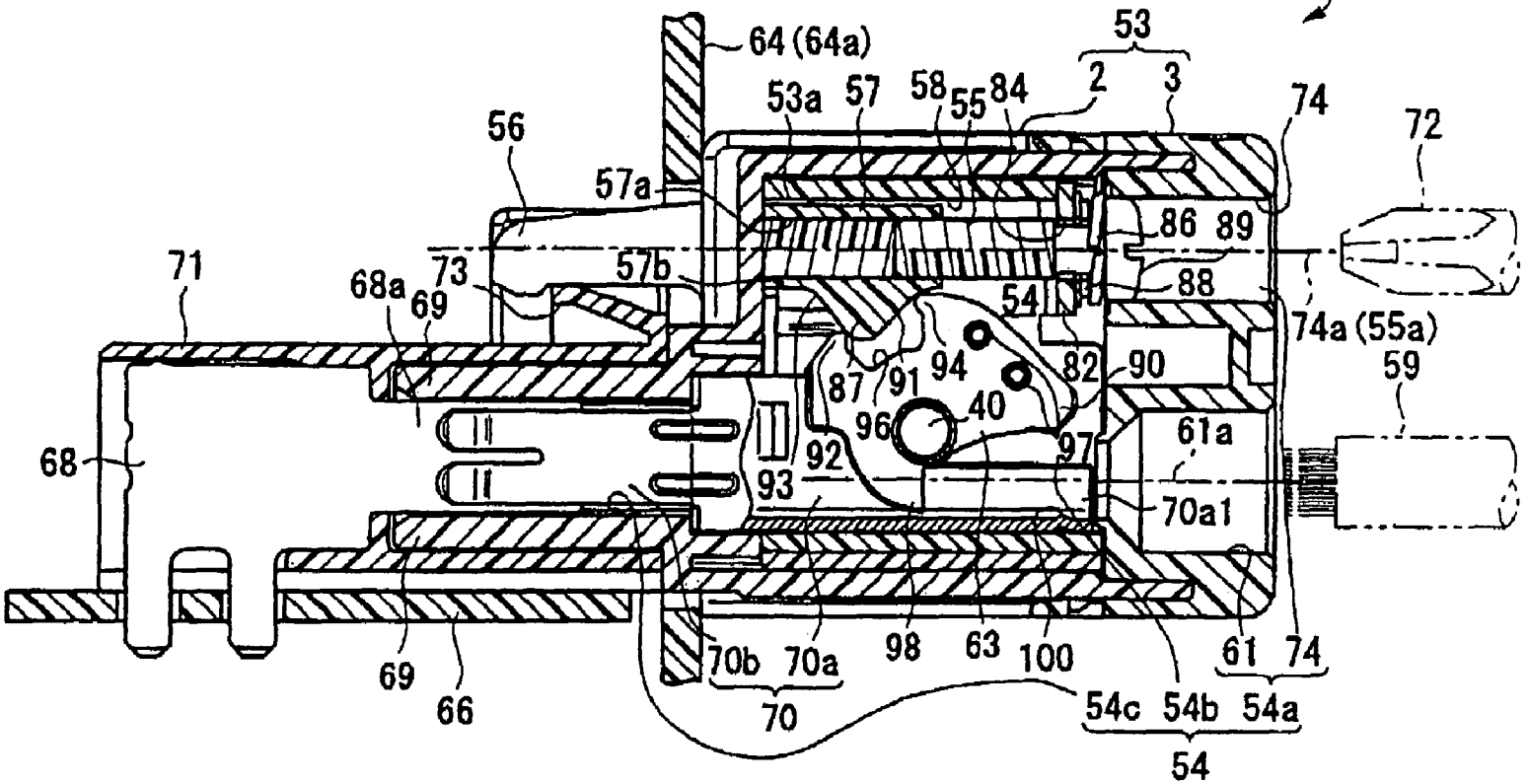
FIG. 4 is a cross-sectional view of the wire connecting device of FIG. 3, taken along line IV—IV thereof.

FIG. 2 is a front view of the wire connecting device 50 as viewed from the direction indicated by arrow II shown in FIG. 1, while FIG. 3 is a plan view of the wire connecting device 50 as viewed from the direction indicated by arrow III shown in FIG. 1. FIG. 4 is an enlarged sectional view taken along line IV—IV in FIG. 3.

As seen from the above drawings, the wire connecting device 50 is configured in such a manner that various constituent members are incorporated in internal spaces 54 of a housing 53 that serves as an outer body of the wire connecting device 50.

The various constituent members of the electric wire connecting device 50 include the following components. The device 50 is intended to receive one or more electrical wires 59, and in the embodiment illustrated, the connecting device 50 may accommodate six individual wires 59. The device includes a plurality of guide holes 61, each of which receives a single wire (typically a multi-strand wire). In order to effect tightening or loosening of the wires in place within the housing 53, screws 55 are provided that can rotate clockwise and counterclockwise about their rotation axes 55*a* in the housing 53, but which are prevented from moving axially. Each screw 55 has a sliders 57 threadedly engaging it. The sliders 57 move forward and backward on their screws 55 in response to different directions of rotation of the screw. For purposes of this disclosure, the forward movement of the slider 57 will be referred to herein as a "go" movement and is movement that occurs from left to right in FIGS. 4–6, while the rearward movement is referred to herein as a "return" movement and is movement which is movement from right to left in FIGS. 4–6. Rotation of the screws 55 in one direction causes a movement of the slider in either a go or return direction, while rotation of the screws in the other direction causes the opposite movement of the slider.

Guide holes 61 guide respective electric wires 59 into the housing 53. Cams 63 are rotatably mounted in the housing 53 and rotate in accordance with movement directions of the sliders 57, respectively, and are provided to press the respective wires 59 at preselected rotation positions, respectively. Connecting-device-side terminals 70 are joined to respective board-side terminals 68 that are provided on a circuit board 66 shown in FIG. 4 that is provided within the electronic apparatus 64.

The housing 53 is composed of a container-shaped base 2 made of resin such as plastic and a cover, or cap 3, that covers the base 2. The internal spaces 54 of the housing 53 are defined by combining the base 2 and the cover 3 together. Each internal space 54 generally consists of three spaces.

As shown in FIG. 4, one space is a guide hole section 54*a* that is formed in the cover 3. The other two spaces are an operation section 54*b* which occupy most of the total internal space of the base 2 and a terminal joining section 54*c* which occupy the remaining internal space of the base 2. The guide hole section 54*a* includes both a driver insertion hole 74 through which to insert a driver 72 to rotate the screw 55 and the above-mentioned guide hole 61 for guiding the wires 59 into the housing 53. The central axis 74*a* of the hole 74 and the central axis 61*a* of the driver insertion hole 61 are preferably parallel with each other. The central axis 74*a* of the driver insertion hole 74 is the same as the central axis 55*a* of the screw 55. For the same of convenience, these axes are shown only in FIG. 4.

The operation section 54*b* is a space that accommodates the screw 55, the slider 57, the cam 63, a main portion 70*a* of the connecting-device-side terminal 70, and other related parts that are incorporated in an inner body 53*a* of the housing 53.

The terminal joining section 54*c* is a space (shown to the left of the panel 64*a* in FIG. 4) where a joining portion 68*a* that is part of the board-side terminal 68, and a joining portion 70*b* that is part of the connecting-device-side terminal 70 are joined to each other. A terminal insertion cylinder that is denoted by reference numeral 69 in FIGS. 1, 3, and 4 defines this space.

When the electric wire connecting device 50 is attached to the electronic apparatus 64, the joining portions 68*a* of the board-side terminals 68 of the electronic apparatus 64 are inserted into the terminal insertion cylinders 69, respectively. As a result, the joining portions 68*a* of the board-side terminals 68 and the joining portions 70*b* of the connecting-device-side terminals 70 are brought into contact with each other, respectively.

The board-side terminals 68 are supported by respective board side terminal support cylinders 71 that are provided on the board 66 of the electronic apparatus 64. The board side terminal support cylinders 71 are fitted with the terminal insertion holes 69 of the electric wire connecting device 50, respectively. As a result, as described above, the joining portions 68*a* of the board-side terminals 68 and the joining portions 70*b* of the connecting-device-side terminals 70 are brought into contact with each other, respectively.

In addition, as shown in FIG. 4, the board side terminal support cylinders 71 have respective engagement pieces 73 to be used for attaching the electric wire connecting device 50 to the electronic apparatus 64. As shown in FIGS. 1 and 4, the electric wire connecting device 50 is formed with engagement arms 56 that correspond to the respective engagement pieces 73.

As seen from FIG. 3, a plurality of internal spaces 54, each of which consists of the three spaces 54*a*, 54*b*, and 54*c*, are formed in the housing 53.

Figure 5:
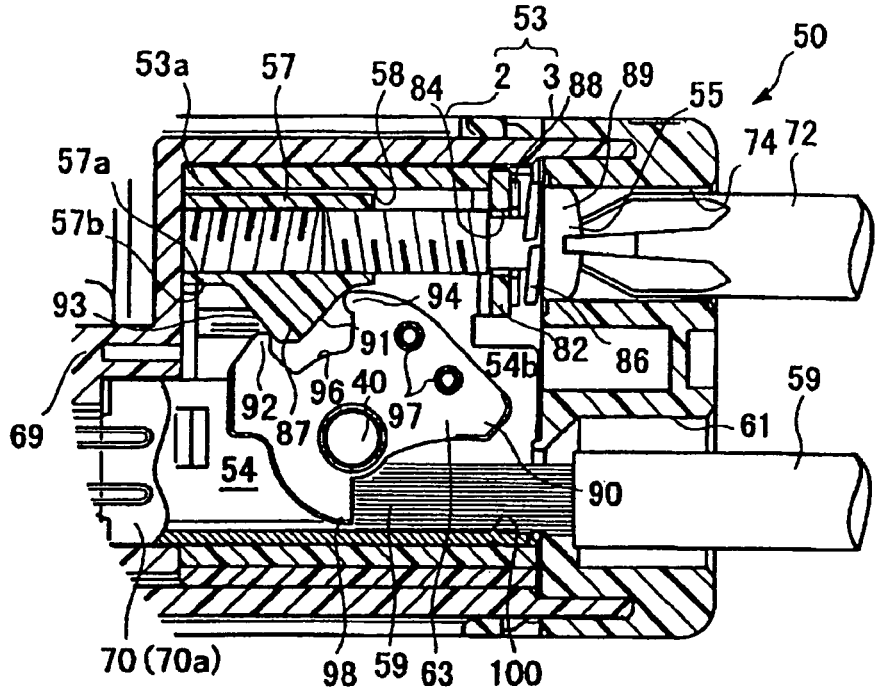
FIG. 5 is the same view as FIG. 4, but the wire being inserted into a wire insertion hole of the wire connecting device and prior to clamping engagement of the wire by the cam.
Figure 6:
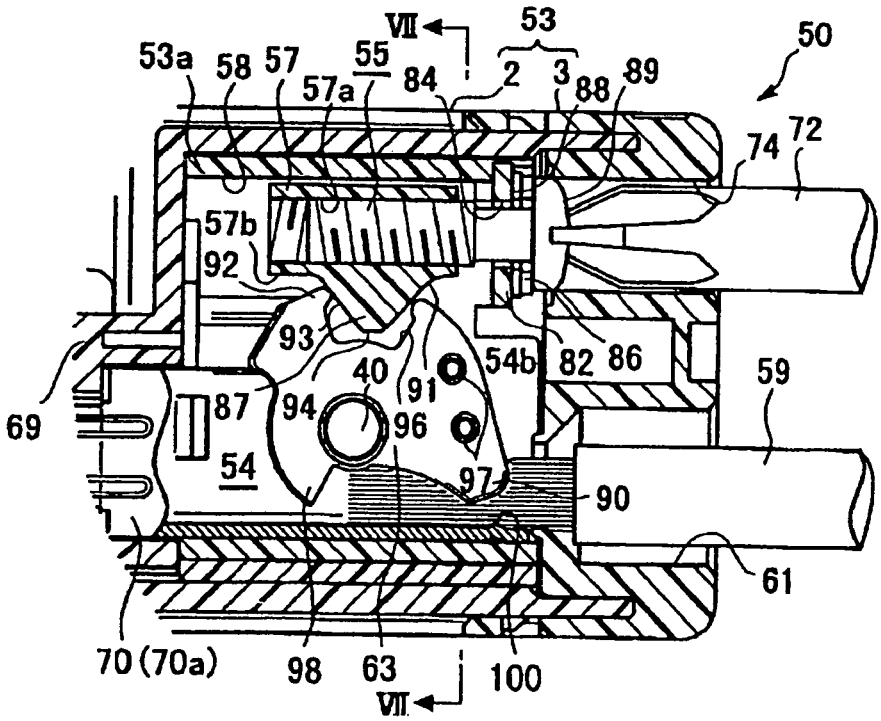
FIG. 6 is the same view as FIG. 5, but illustrating the structure of the wire connecting device after the wire clamping screw has been turned to advance the cam into clamping engagement with the wire inserted in the insertion hole; and, FIG. 7 is a sectional view taken along line VII—VII in FIG. 6.

As shown in FIGS. 4–6, each screw 55 is inserted in a spring washer 86 and a flat washer 88 and also inserted in, in a clearance fit, in a through-hole 84 of a support plate 82 that extends vertically from the top wall (FIG. 4) of a wall 80 that defines the operation section 54*b*. The screw 55 is somewhat longer than a half of the length dimension of the operation section 54*b*. Before the slider 57 is threadedly engaged with the screw 55, the screw 55 is supported by the support plate 82 in a cantilever-like manner.

The slider 57 is formed with a threaded hole 57*a* at the center. The slider 57 can slide in the axial direction of the screw 55 and is at least partly guided in its sliding movement by a groove 58 of the internal wall of the connecting device operation section 54*b*.

A frustoconical (in a vertical cross-section) projection 87 projects from a wall 57*b* of the slider 57 that is located on the side closer to the center of the operation section 54*b*. The cam 63 is hooked (described later in detail) on an inclined surface 91 disposed on the front of the slider projection 87 on the side closer to the head 89 of the screw 55 and its inclined surface 93 on the opposite side.

It is preferable that the strength of the frictional force acting between the threaded hole 57*a* and the screw 55 be such as to cause frictional drag that prevents the slider 57 from moving even when force resulting from the weight of the cam 63 itself acts on the slider 57.

The guide hole 61 is a through-hole that is formed through a portion of the wall 80 of the operation section 54*b* that is close to the bottom wall (FIG. 4) of the wall 80. The driver insertion hole 74 is located above the guide hole 61.

The cam 63 can rotate freely in the inner body 53*a* of the housing 53 about a rotary shaft 40 that bridges the walls of the housing 53 so as to traverse the operation sections 54*b*. The cam 63 has a pressing portion 90 (FIG. 6) for pressing against the wire 59, a recess 96 that has hooking nails, or projections 92 and 94, that engage with the opposing surfaces of the slider projection 87, and which may be considered to surround the top portion of the projection 87. The cam also preferably includes a stopper 98 for preventing the advance of the wires 59 once the wires 59 have been introduced into the housing 53 for a preselected length.

The slider 57 can be moved to the leftmost position in FIG. 4 by rotating the screw 55 with the driver 72. In this state, the stopper 98 and its flat wire stop surface disposed thereon faces the wire guide opening 61. The stopper 98 is located behind the wire accommodating portion 70*a*1 (i.e., on the side opposite to the guide hole 61) that is part of the main portion 70*a* of the connecting-device-side terminal 70 and is provided in the operation section 54*b* so as to be continuous with the guide hole 61. The stopper 98 thus prevents further advance of the wire 59 in the connecting device. The wire accommodating portion 70*a*1 may also be called a guide hole because it is an extension of the guide hole 61,.

Figure 7:
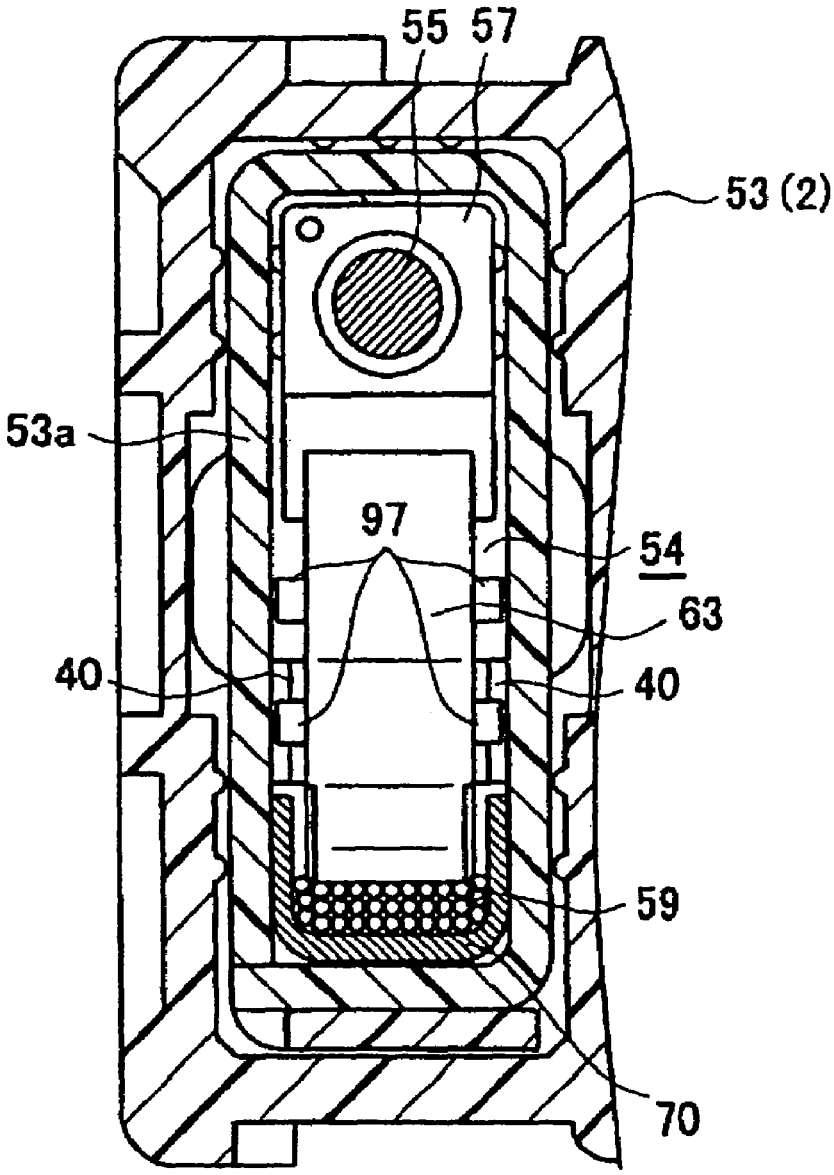

As shown in FIG. 7, both side surfaces of the cam 63 is formed with a plurality of (in this embodiment, four) support projections 97 that may contact the inner surfaces of the inner body 53*a*. The support projections 97 are provided to secure stable rotation of the cam 63 with respect to the inner body 53*a* so that it rotates in a true fashion and does not wobble, or tilt, during its operation.

As shown in FIG. 4, the connecting-device-side terminal 70 is provided in the operation section 54*b* on the opposite side of the cam 63 to the screw 55 in the vertical direction.

As described above, as shown in FIG. 4, the wire accommodating portion 70*a*1 for accommodating the electric wire 59 to be introduced through the guide hole 61 is formed as a tip portion of the main portion 70*a* of the connecting-device-side terminal 70. The wire accommodating portion 70*a*1 assumes a U-shape in a vertical cross-section and is open on the top side. (FIG. 4.) The bottom surface of the wire accommodating portion 70*a*1 is formed with wire coming-off preventive projections 100.

Next, the functions and advantages of the embodiment will be described.

To clamp a wire 59 using the connecting device 50, a screwdriver 72 is inserted into the driver insertion hole 74 and the screw 55 is rotated until the pressing portion 90 of the cam 63 is located above the wire accommodating portion 70*a*1 as shown in FIGS. 4 and 5.

As a result, being guided by the groove 58, the slider 57 is retreated, that is, moved leftward. (FIG. 4.) As the slider 57 moves so, the cam 63 is rotated counterclockwise about the rotation axis 40. At this time, the rear hooking piece 92 of the cam 63 is in contact with and is hooked on the surface 93 of the frustoconical projection 87 of the slider 57. The front hooking piece 94 is slightly off the surface 91. Then, the screw 55 is rotated with the driver 72, whereby the slider 57 is moved rightward as shown in FIG. 6. As a result, the cam 63 is rotated clockwise and the wire accommodating portion 70*a*1 of the connecting-device-side terminal 70 is closed by the pressing portion 90.

The surface 93 of the projection 87 of the slider 57 that contacts the hooking piece 92 of the cam 63 when the wire accommodating portion 70*a*1 is closed by the pressing portion 90 may be called a return-side surface of the slider and the surface 91 on the opposite side may be called a go-side surface.

When the cam 63 is rotated counterclockwise by rotating the screw 55 with the driver 72, the wire accommodating portion 70*a*1 that has been closed by the pressing portion 90 is opened, so that a wire 59 may be inserted into the guide hole 61. In this state, the stopper 98 of the cam 63 is located behind the wire accommodating portion 70*a*1 (i.e., on the side opposite to the guide hole 61) and prevents the advance of the wire 59. The wire 59 is inserted until its end contacts the stopper 98. The length of wire insertion is set at such a length that is suitable for the connection of the wire 59.

After the electric wire 59 has been inserted into the wire accommodating portion 70*a*1, the screw 55 is rotated in the direction opposite to the direction of the preceding rotation, and the cam 63 is rotated clockwise, whereby the cam wire pressing portion 90 presses down against the wire 59. As a result, the wire 59 is held between the cam wire pressing portion 90 and the wire coming-off preventive projections 100, whereby the wire 59 is prevented from coming out from the wire connecting device 50.

Conversely, to remove the wire 59 from the wire connecting device 50, the screw 55 is rotated so that the cam 63 rotate counterclockwise, whereby the pressing of the wire 59 by the pressing portion 90 is canceled.

When the screw 55 is rotated, the slider 57 makes a go-movement or a return-movement in the axial direction of the screw 55 in accordance with the rotation of the screw 55 while friction is caused between the threadedly engaged portions of the screw 55 and the slider 57. Being in contact with the slider 57, the cam 63 is rotated clockwise or counterclockwise in accordance with the movement direction of the slider 57. In other words, the cam 63 does not rotate unless the slider 57 is moved.

However, as described above, frictional drag occurs between the threadedly engaged portions of the screw 55 and the slider 57. Therefore, to move the slider 57, an external force that is stronger than the frictional drag (from the screwdriver) should be exerted on the slider 57. The cam 63 that is in contact with the slider 57 does not rotate unless the slider 57 is moved. That is, the cam 63 does not rotate unless external force acting on the slider 57 is stronger than the frictional drag. It can be said that the rotation of the cam 63 is restricted by the slider 57.

Rotating the screw 55 with the driver 72 is not the only cause of external force that acts on the slider 57; there may occur a case that the cam 63 exerts external force on the slider 57. For example, the weight of the cam 63 itself may cause external force. In this case, the slider 57 is moved if the force exerted on the slider 57 by the cam 63 is stronger than the frictional drag between the threadedly engaged portions of the screw 55 and the slider 57.

There may occur a case that the wire accommodating portion **70*a*1 is shut by the cam 63. If a wire 59 is inserted into the wire accommodating portion 70*a*1 in this state, the advance of the wire 59** is obstructed.

Therefore, the frictional drag between the threadedly engaged portions of the screw 55 and the slider 57 should be sufficiently strong so as to prevent an event that the weight of the cam 63 itself overcomes the frictional drag between the threadedly engaged portions of the screw 55 and the slider 57 and the cam 63 shuts the wire accommodating portion **70*a*1 undesirably. This measure prevents the cam 63 from moving undesirably, and hence the cam 63 can be prevented from hitting the walls or the constituent parts of the electric wire connecting device 50. Further, there does not occur a phenomenon that the cam 63 shuts the wire accommodating portion 70*a*1 before a wire 59 is inserted into it. Therefore, even if the wire 59 is inserted into the guide hole 61 without checking whether the wire accommodating portion 70*a*1 is shut by the cam 63, the advance of the wire 59 (a stranded wire or thin wires constituting it) is not obstructed. This effectively prevents a phenomenon that it is difficult to insert the wire 59 into the wire accommodating portion 70*a*1** or a stranded wire is unraveled.

As described above, according to the invention, the cam does not rotate undesirably and hence a phenomenon that the wire insertion hole of the electric wire connecting device is shut by the cam can be prevented. Therefore, when an electric wire is inserted into the wire insertion hole, the advance of the electric wire (a stranded wire or thin wires constituting it) is not obstructed. This prevents a phenomenon that it is difficult to insert an electric wire into the wire accommodating hole or a stranded wire is unraveled.

While the preferred embodiment of the invention have been shown and described, it will be apparent to those skilled in the art that changes and modifications may be made therein without departing from the spirit of the invention, the scope of which is defined by the appended claims.

The invention claimed is:

1. An electrical wire connecting device, comprising:

an insulative housing;

a screw mounted for rotation in the housing, the screw being capable of selective rotation in a first or second direction about a rotational axis at a preselected level with said housing, said screw being restrained from axial movement within said housing;

a slider supported within said housing and engaged with said screw and capable of forward or rearward axial movement within said housing in accordance with the screw rotation direction;

a guide hole disposed in said housing spaced apart from said screw, the guide hole providing a passage into said housing which receives an electrical wire inserted into said housing, said housing further including a conductive contact proximate to said guide hole for contact the wire inserted into said guide hole, said conductive contact being electrically coupled to terminals that extend from said electrical wire connecting device and that are capable of being coupled to a circuit board; and, a cam for selectively pressing said wire inserted into said guide hole into electrical contact with said contact, the cam including a body portion rotatably mounted within said housing, the cam including a wire-contacting portion for pressing said wire inserted into said guide hole against said contact, said cam wire-contacting portion rotating into pressing engagement with said wire when said screw is turned in said first direction and said slider moves in a forward direction and said cam wire-contacting portion rotating out of pressing engagement with said wire to permit said wire to be removed from said guide hole when said screw is turned in said second direction and said slider moves in a rearward direction, whereby frictional drag between said screw and slide, prevents the cam weight from rotating the cam to obstruct insertion of a wire into the guide hole, said slider including a threaded hole that threadedly engages said screw, and wherein said frictional drag acting between said screw and the threaded hole opf said slider prevents said slider from moving without rotating said screw.

2. The wire connecting device according to claim 1, wherein said guide hole and said screw are parallel to each other within said housing.

3. The wire connecting device according to claim 1, wherein said cam includes at least two projections extending transversely from said cam body toward opposing walls of said housing, the projections maintaining substantially true rotation of said cam within said housing.

4. The wire connecting device according to claim 1, wherein said guide hole includes a lead in surface.

5. The wire connecting device according to claim 1, wherein said slider includes a projection disposed thereon, and wherein said cam includes a recess disposed on the cam body, the cam recess receiving the slider projection therein.

6. The wire connecting device according to claim 5, wherein said slider projection is frustoconical.

7. The wire connecting device according to claim 5, wherein said cam recess includes a pair of opposing hook surfaces that project partially into said cam recess, the cam cavity hook surfaces engaging said slider projection from opposite directions.

8. The wire connecting device according to claim 1, wherein said contact defines a surface of said guide hole.

9. The wire connecting device according to claim 8, wherein said contact projects rearwardly of said housing.

10. The wire connecting device according to claim 1, wherein said cam includes a stopper that is moved into said guide hole by rotation of said screw in said second direction, the stopper preventing insertion of said wire into said guide hole a distance more than a preselected length.

11. The wire connecting device according to claim 10, wherein said cam wire-contacting portion and said cam stopper are spaced circumferentially apart from each other on said cam body.

12. An electrical wire connecting device, comprising:

an insulative housing;

a screw mounted for rotation in the housing, the screw being capable of selective rotation in a first or second direction about a rotational axis at a preselected level with said housing, said screw being restrained from axial movement within said housing;

a slider supported within said housing and engaged with said screw and capable of forward or rearward axial movement within said housing in accordance with the screw rotation direction;

a guide hole disposed in said housing spaced apart from said screw, the guide hole providing a passage into said housing which receives an electrical wire inserted into said housing, said housing further including a conductive contact proximate to said guide hole for contact the wire inserted into said guide hole, said conductive contact being electrically coupled to terminals that extend from said electrical wire connecting device and that are capable of being coupled to a circuit board; and, a cam for selectively pressing said wire inserted into said guide hole into electrical contact with said contact, the cam including a body portion rotatably mounted within said housing, the cam including a wire-contacting portion for pressing said wire inserted into said guide hole against said contact, said cam wire-contacting portion rotating into pressing engagement with said wire when said screw is turned in said first direction and said slider moves in a forward direction and said cam wire-contacting portion rotating out of pressing engagement with said wire to permit said wire to be removed from said guide hole when said screw is turned in said second direction and said slider moves in a rearward direction, said cam includes a stopper that is moved into said guide hole by rotation of said screw in said second direction, the stopper preventing insertion of said wire into said guide hole a distance more than a preselected length.

13. An electrical wire connecting device, comprising:

an insulative housing;

a screw mounted for rotation in the housing, the screw being capable of selective rotation in a first or second direction about a rotational axis at a preselected level with said housing, said screw being restrained from axial movement within said housing;

a slider supported within said housing and engaged with said screw and capable of forward or rearward axial movement within said housing in accordance with the screw rotation direction;

a guide hole disposed in said housing spaced apart from said screw, the guide hole providing a passage into said housing which receives an electrical wire inserted into said housing, said housing further including a conductive contact proximate to said guide hole for contact the wire inserted into said guide hole, said conductive contact being electrically coupled to terminals that extend from said electrical wire connecting device and that are capable of being coupled to a circuit board; and, a cam for selectively pressing said wire inserted into said guide hole into electrical contact with said contact, the cam including a body portion rotatably mounted within said housing, the cam including a wire-contacting portion for pressing said wire inserted into said guide hole against said contact, said cam wire-contacting portion rotating into pressing engagement with said wire when said screw is turned in said first direction and said slider moves in a forward direction and said cam wire-contacting portion rotating out of pressing engagement with said wire to permit said wire to be removed from said guide hole when said screw is turned in said second direction and said slider moves in a rearward direction, said slider including a projection disposed thereon, and wherein said cam includes a recess disposed on the cam body portion, the cam recess receiving the slider projection therein.

* * * * *